US010670989B1

(12) United States Patent
Zhu et al.

(10) Patent No.: US 10,670,989 B1
(45) Date of Patent: Jun. 2, 2020

(54) DEVELOPER REPLENISHMENT CARTRIDGE AND METHOD FOR REPLENISHING DEVELOPER

(71) Applicant: JIANGXI KILIDER TECHNOLOGY CO., LTD., Shangrao (CN)

(72) Inventors: Jinjun Zhu, Shangrao (CN); Zhongxi Li, Shangrao (CN); Jiabing He, Shangrao (CN)

(73) Assignee: JIANGXI KILIDER TECHNOLOGY CO., LTD., Shangrao (CN)

( * ) Notice: Subject to any disclaimer, the term of this patent is extended or adjusted under 35 U.S.C. 154(b) by 0 days.

(21) Appl. No.: 16/451,011

(22) Filed: Jun. 25, 2019

(30) Foreign Application Priority Data

Jun. 10, 2019 (CN) ..... 2019 1 0495312

(51) Int. Cl.
*G03G 15/08* (2006.01)

(52) U.S. Cl.
CPC ..... *G03G 15/0886* (2013.01); *G03G 15/0881* (2013.01); *G03G 15/0889* (2013.01); *G03G 15/0894* (2013.01)

(58) Field of Classification Search
CPC ..... G03G 15/0886; G03G 15/0889; G03G 15/0881; G03G 15/0894
See application file for complete search history.

(56) References Cited

U.S. PATENT DOCUMENTS

| | | | | |
|---|---|---|---|---|
| 8,682,213 | B2 * | 3/2014 | Carter | G03G 15/0886 399/111 |
| 9,360,797 | B1 * | 6/2016 | Bayubay | G03G 21/1896 |
| 9,477,178 | B1 * | 10/2016 | Bayubay | G03G 21/1821 |
| 2010/0247160 | A1 * | 9/2010 | Ohta | G03G 15/0875 399/262 |
| 2013/0170868 | A1 * | 7/2013 | Acosta | G03G 21/1814 399/258 |

* cited by examiner

*Primary Examiner* — Carla J Therrien

(57) ABSTRACT

The present application provides a developer replenishment cartridge including a housing, a first rotating shaft connected to a first end portion of the housing via a sealing bearing, a wiper blade connected to a bracket beside the first rotating shaft via at least one bolt. The present application further provides a method for replenishing developer, including pressing a button inward to move the push rod forward in such a way that a front end of the push rod firstly contacts a baffle provided at an inlet of the toner cartridge for the developer in the equipment, aligning the sealing gear with the discharge port communicating with the middle of the outlet, opening the developer container, driving the wiper blade to rotate by the driving wheel of the driving unit, mixing up the developer inside the container, and feeding the developer toward the region of the second rotating shaft.

6 Claims, 5 Drawing Sheets

DEVELOPER REPLENISHMENT CARTRIDGE AND METHOD FOR REPLENISHING DEVELOPER

CROSS-REFERENCE TO RELATED APPLICATIONS

This application claims priority to Chinese Patent Application No. 201910495312.7, filed Jun. 10, 2019, which is hereby incorporated by reference herein as if set forth in its entirety.

TECHNICAL FIELD

The present application relates to a field of developer, in particular to a developer replenishment cartridge, and further to a method for replenishing developer.

BACKGROUND

A developer is a medicament for converting a latent image generated by exposure of a photosensitive material into a visible image. In terms of chemical components, the developer can be classified into two major categories of inorganic compounds and organic compounds.

In the prior art, leakage is likely to occur in the known supply container during production or shipment of the developer products in the case that the connecting shaft is accidentally collided to cause the powder outlet of the developer replenishment container to open in such a way that the developer flows out of the developer supply container.

As such, a developer replenishment cartridge and a method for replenishing developer are provided to solve the problems existing in the prior art, simplify the operation principle thereof, and ensure maintaining of all functions and no leakage of the developer.

SUMMARY

The object of the present application is to provide a developer replenishment cartridge and a method for replenishing developer, for solving the problem existed in the prior that the connecting shaft is accidentally collided to cause leakage of the developer from of the developer supply container.

The following technical schemes are used for achieving the above-mentioned object.

A developer replenishment cartridge is provided, including a housing, a first rotating shaft connected to a first end portion of the housing via a sealing bearing, at least one wiper blade connected to a bracket beside the first rotating shaft via at least one bolt, and a second rotating shaft mounted on an inner side of the housing and matching with the first rotating shaft, an outlet provided at a second end portion of the housing and communicating with the second rotating shaft, and a sealing gear inserted in the middle of the outlet, a push rod inserted into a groove at the second end portion of the housing, a stop block base connected in the middle of the push rod by at least one bolt, a stop block engaged with the middle of the stop block base and having a low end inserted into a branch from an end portion of the push rod, and a push rod teeth provided at the end portion of the push rod and matching with the sealing gear;

wherein a first driving gear is connected to an end of the first rotating shaft by means of a key joint, a second driving gear is connected to an end of the second rotating shaft by means of a key joint, a driven gear is connected to the middle of the housing via a rotary shaft, both sides of the driven gear are engaged with the first driving gear and the second driving gear respectively, and a driving wheel located above the first driving gear is connected to the first end portion of the housing via a rotary shaft and is engaged with the first driving gear.

In some embodiments, the push rod has a protrusion in the middle thereof sleeved with a first spring, and the first spring has one end in contact with the housing.

In some embodiments, a second spring is provided and has one end bolted to the middle of the stop block base and one other end bolted to the stop block.

In some embodiments, the sealing gear has a gear structure at an end portion thereof, and a discharge port communicating with the middle of the outlet is provided at the middle of an end portion of the sealing gear.

In some embodiments, a gear cover is engaged at the first end portion of the housing, and a guiding rail is provided in the middle of the gear cover.

In some embodiments, a positioning pillar is inserted into a groove at the middle of the push rod, and the positioning pillar has an end screwed to the housing.

A method for replenishing developer is provided, including the steps of, step 1, closing a front cover with a pushing post provided thereon of an equipment after installing the developer replenishment cartridge to the equipment, pressing a button inward to move the push rod forward along the positioning pillar, in such a way that a front end of the push rod firstly contacts a baffle provided at an inlet of a toner cartridge for the developer in the equipment and then opens the inlet of the toner cartridge for the developer;

step 2, continuously pushing the push rod to drive the sealing gear to rotate after the push rod teeth and the sealing gear are engaged with each other, so that the sealing gear is aligned with the discharge port communicating with the middle of the outlet, and the developer replenishment cartridge is opened;

step 3, driving a gear of the first rotating shaft to rotate by the driving wheel of the driving unit after the outlet of the developer replenishment cartridge is opened, such that the first rotating shaft is rotated by the gear of the first rotating shaft, and two wiper blades equipped on the first rotating shaft are rotated simultaneously to stir and mix up the developer inside the container so as to feed the developer toward the region of the second rotating shaft, and wherein an auxiliary blade is further provided inside the housing to guide feeding of the developer.

The present application provides a developer replenishment cartridge and a method for replenishing developer, which have the following technical effects and advantages compared with the prior art.

According to the present application, the operation principle of the developer replenishment cartridge is simplified, and maintaining of all functions is ensured. The stop block is not pressed inward when the developer replenishment cartridge is free of installation to the equipment, such that the stop block gets stuck in a hole for the stop block at the end of the housing, and thus the push rod gets stuck via the stop block and does not move forward to contact with the sealing gear, so that the developer replenishment opening is not opened, thereby avoiding leakage of the developer.

Figure 1:
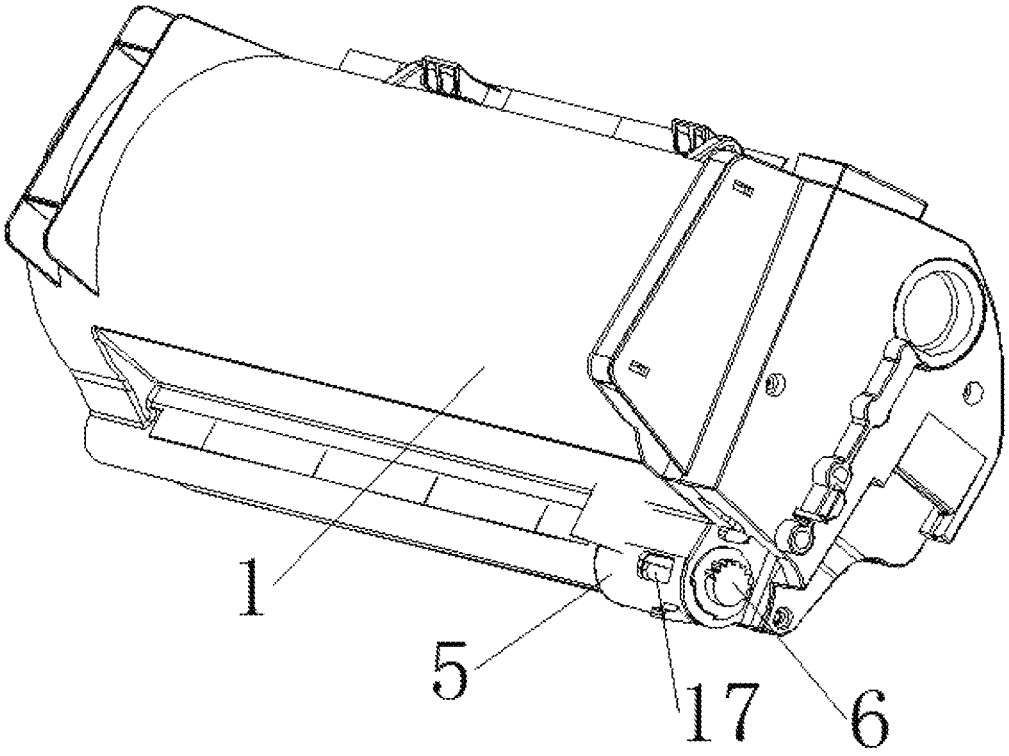
FIG. 1 schematically shows a structural view of a developer replenishment cartridge according to the present application.
Figure 2:
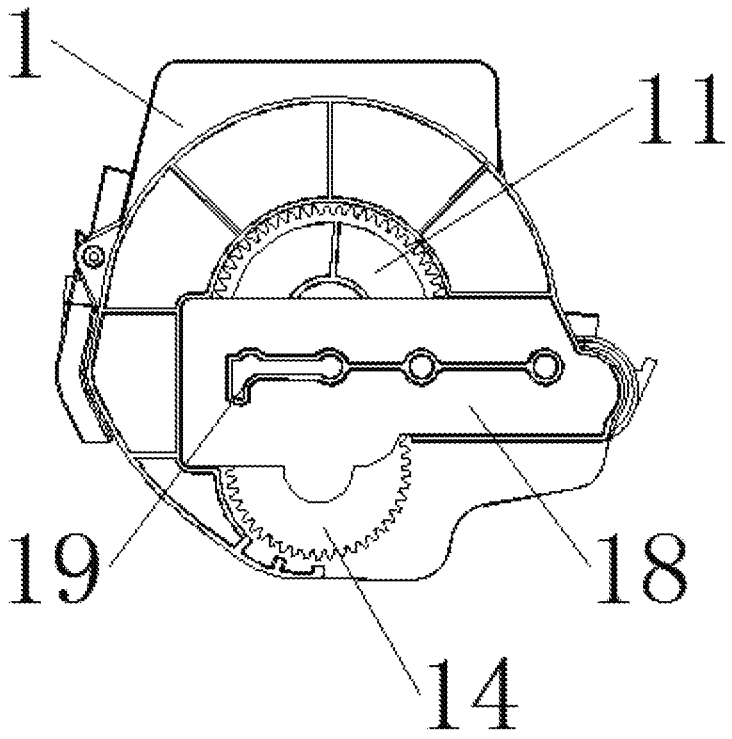
FIG. 2 schematically shows a structural side view of the developer replenishment cartridge according to the present application.

In the drawings, 1, housing; 2, first rotating shaft; 3, wiper blade; 4, second rotating shaft; 5, outlet; 6, sealing gear; 7, push rod; 8, stop block base; 9, stop block; 10, push rod teeth; 11, first driving gear; 12, second driving gear; 13, driven gear; 14, driving wheel; 15, first spring; 16, second spring; 17, discharge port; 18, gear cover; 19, guiding rail; 20, positioning pillar.

DETAILED DESCRIPTION

Embodiments according to the present application will be further described below with reference to the accompanying drawings for more clearly and fully discussing the technical solutions of the present application. Apparently, the described embodiments are only a part of the embodiments of the present application, and not all of them. It should be appreciated that specific embodiments described herein are merely illustrative of the present application and are not intended to limit the present application. Modifications and variations made by those skilled in the art based on the embodiments according to the present application without any creative work fall within the protection scope of the present application.

Figure 3:
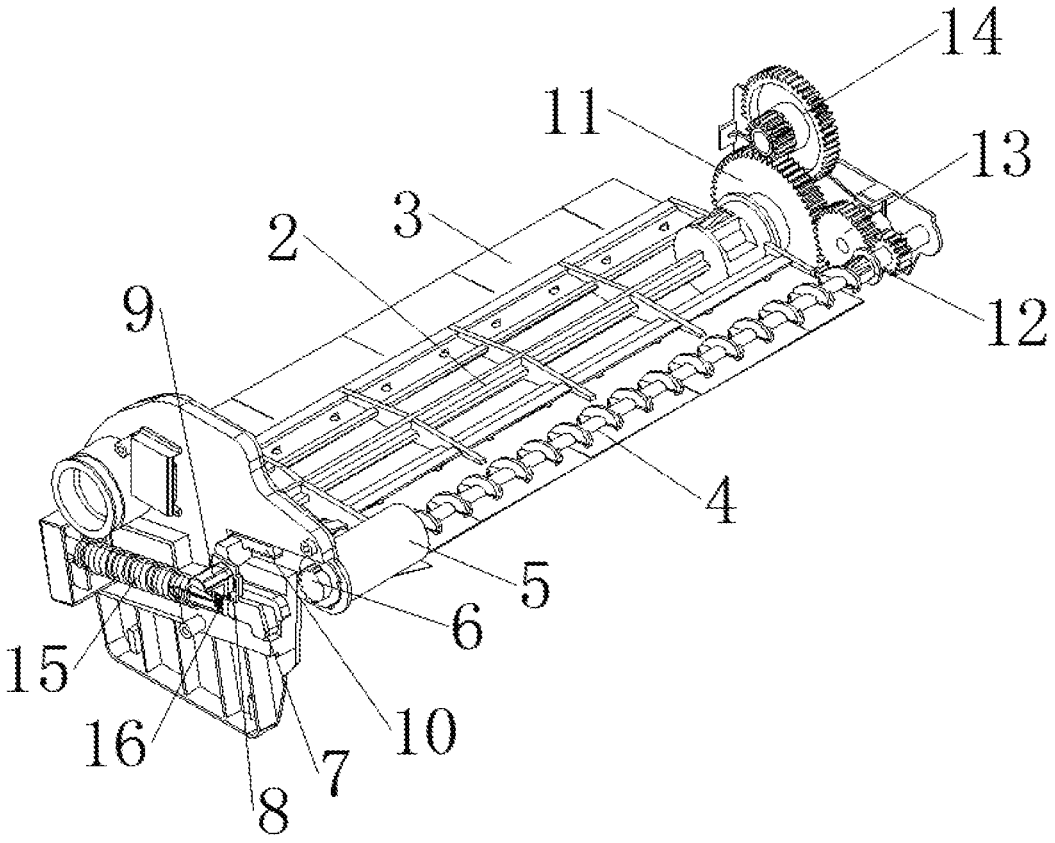
FIG. 3 schematically shows a structural view of internal parts of the developer replenishment cartridge according to the present application.
Figure 4:
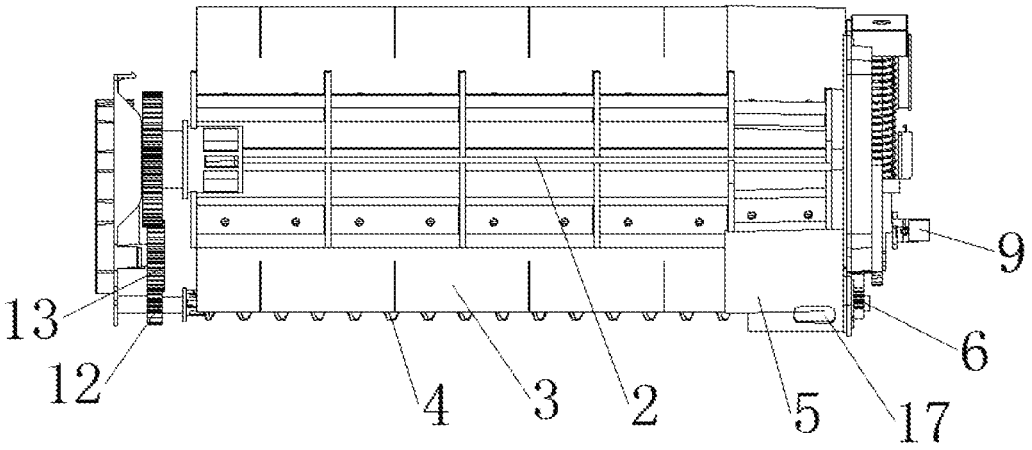
FIG. 4 schematically shows a structural top view of the internal parts of the developer replenishment cartridge according to the present application.
Figure 5:
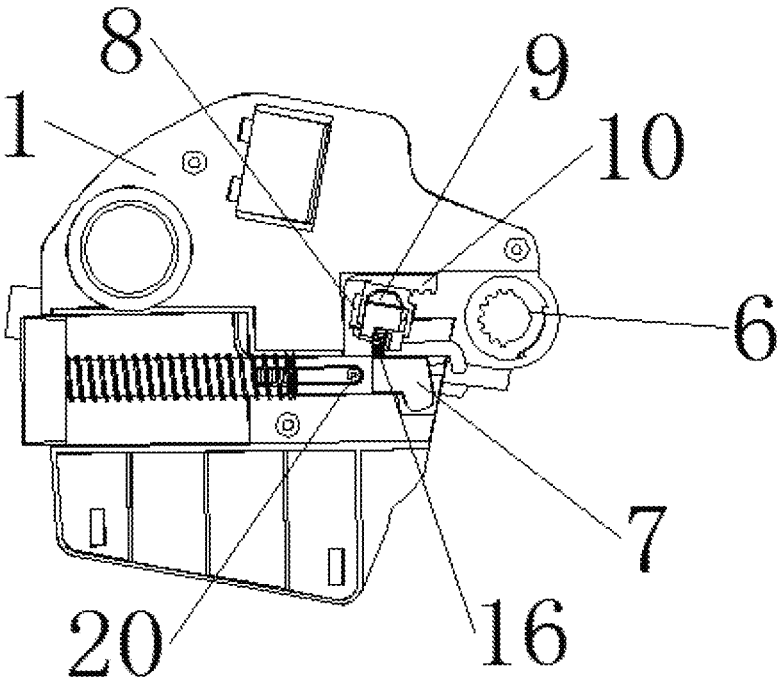
FIG. 5 schematically shows a structural view of a push rod assembly according to the present application.

As shown in FIGS. 1-5, a developer replenishment cartridge is provided according to the present application, including a housing 1. A first rotating shaft 2 is connected to a first end portion of the housing 1 via a sealing bearing. At least one wiper blade 3 is bolted to a bracket beside the first rotating shaft 2. A second rotating shaft 4 is mounted on an inner side of the housing 1 and matches with the first rotating shaft 2. An outlet 5 is provided at a second end portion of the housing 1 and communicates with the second rotating shaft 4. A sealing gear 6 is inserted in the middle of the outlet 5. A push rod 7 is inserted into and movable in a groove at the second end portion of the housing 1. A stop block base 8 is bolted to the middle of the push rod 7. A stop block 9 is fixed to the middle of the stop block base 8 and has a low end inserted into a branch from an end portion of the push rod 7. A push rod teeth 10 is fixed to the push rod 7 and matches with the sealing gear 6. As shown in FIG. 3. in one embodiment, the push rod teeth 10 is fixed to the stop block base 8 and thus indirectly fixed to the push rod 7 through the stop block base 8. The wiper blade 3 connected with the first rotating shaft 2 inside the housing 1 is configured to mix up the developer and meanwhile to scrape the developer to the vicinity of the second rotating shaft 4. The second rotating shaft 4 with a worm structure is rotated to feed the developer into the outlet 5. The push rod 7 is pushed so that the push rod teeth 10 are in contact with the sealing gear 6. The push rod 7 is continuously pushed to drive the sealing gear 6 to rotate so that the sealing gear is aligned with a through hole at the outlet 5 to facilitate replenishment of the developer.

A first driving gear 11 is connected to an end of the first rotating shaft 2 by means of a key joint. A second driving gear 12 is connected to an end of the second rotating shaft 4 by means of a key joint. A driven gear 13 is connected to the middle of the housing 1 via a rotary shaft. Both sides of the driven gear 13 are engaged with the first driving gear 11 and the second driving gear 12 respectively. A driving wheel 14 located above the first driving gear 11 is connected to the first end portion of the housing 1 via a rotary shaft. The driving wheel 14 is engaged with the first driving gear 11 and is configured to drive the first driving gear 11 to rotate. The second driving gear 12 rotates with the rotation of the first driving gear 11 via the driven gear 13, so that the first rotating shaft 2 and the second rotating shaft 4 rotate synchronously to facilitate replenishment of the developer.

Specifically, the push rod 7 has a protrusion in the middle thereof sleeved with a first spring 15. The first spring 15 has one end in contact with the housing 1. The first spring 15 is configured to connect the housing 1 to the push rod 7 and to provide the push rod 7 with a pushing force for forward movement, so as to facilitate connection with a printing equipment.

Specifically, a second spring 16 is provided and has one end bolted to the middle of the stop block base 8 and one other end bolted to the stop block 9 for applying a push force to the stop block 9. The stop block 9 is configured to be inserted into an escape hole at the second end portion of the housing 1 when being aligned with the escape hole, such that the push rod 7 is positioned and fixed without being loosened.

Specifically, the sealing gear 6 has a gear structure at an end portion thereof. A discharge port 17 communicating with the middle of the outlet 5 is provided at the middle of an end portion of the sealing gear 6. The developer can be discharged when the outlet 5 is aligned with the discharge port 17 of the sealing gear 6.

Specifically, a gear cover 18 is engaged at the first end portion of the housing 1 and is provided with a guiding rail 19 in the middle of the gear cover 18. The gear cover 18 is configured to protect the gear assembly mounted at the first end portion of the housing 1, so as to prevent the gear assembly from being loosened. The guiding rail 19 is configured to guide the developer replenishment cartridge to ensure the accuracy of installation.

Specifically, a positioning pillar 20 is inserted into a groove at the middle of the push rod 7, and has an end screwed to the housing 1. The positioning pillar 20 is configured to guide the push rod 7 to prevent the push rod 7 from being loosened.

A method for replenishing developer is provided according to the present application, including the following steps.

Step 1, a front cover with a pushing post provided thereon of an equipment is closed after installing the developer replenishment cartridge to the equipment, a button is pressed inward to move the push rod forward along the positioning pillar, in such a way that a front end of the push rod firstly contacts a baffle provided at an inlet of a toner cartridge for the developer in the equipment and then opens the inlet of the toner cartridge for the developer.

Step 2, the push rod is continuously pushed to drive the sealing gear to rotate after the push rod teeth and the sealing gear are engaged with each other, so that the sealing gear is aligned with the discharge port communicating with the middle of the outlet, and the developer replenishment cartridge is opened.

Step 3, a gear of the first rotating shaft is driven to rotate by the driving wheel of the driving unit after the outlet of the developer replenishment cartridge is opened, such that the first rotating shaft is rotated by the gear of the first rotating shaft, and two wiper blades equipped on the first rotating shaft are rotated simultaneously to stir and mix up the developer inside the container, so as to feed the developer toward the region of the second rotating shaft. As an alternative, an auxiliary blade is further provided inside the housing to guide feeding of the developer.

Construction principle of the present application is explained as follows. The wiper blade 3 connected with the first rotating shaft 2 inside the housing 1 is configured to mix up the developer and meanwhile to scrape the developer to the vicinity of the second rotating shaft 4. The second rotating shaft 4 with a worm structure is rotated to feed the developer into the outlet 5. The push rod 7 is pushed so that the push rod teeth 10 are in contact with the sealing gear 6. The push rod 7 is continuously pushed to drive the sealing gear 6 to rotate so that the sealing gear is aligned with a through hole at the outlet 5 to facilitate replenishment of the developer. The second driving gear 12 rotates with the rotation of the first driving gear 11 via the driven gear 13, so that the first rotating shaft 2 and the second rotating shaft 4 rotate synchronously to facilitate replenishment of the developer. The first spring 15 is configured to connect the housing 1 to the push rod 7 and to provide the push rod 7 with a pushing force for forward movement, so as to facilitate connection with a printing equipment.

Described above are only preferred embodiments of the present application and are not intended to limit the present application. Although the present application is described in detail with reference to the foregoing embodiments, it is still possible for a person skilled in the art to modify the technical solutions described in the foregoing embodiments, or to equally replace some of the technical features therein. Any equivalent changes and modification made within the scope of the claims of the present application shall be covered by the scope of the claims of the present application.

What is claimed is:

1. A developer replenishment cartridge, comprising a housing, a first rotating shaft rotatably connected to a first end portion of the housing, at least one wiper blade connected to the first rotating shaft, and a second rotating shaft mounted on an inner side of the housing and matching with the first rotating shaft, an outlet provided at a second end portion of the housing and communicating with the second rotating shaft, and a sealing gear inserted in the outlet, a push rod inserted into and movable in a groove at the second end portion of the housing, a stop block base fixed to the push rod, a stop block fixed to the stop block base, and a push rod teeth provided at an end portion of the push rod and translating to move into and out of contact with the sealing gear;

wherein a first driving gear is connected to an end of the first rotating shaft, a second driving gear is connected to an end of the second rotating shaft, a driven gear is connected to the housing, the driven gear is engaged with the first driving gear and the second driving gear, and a driving wheel located above the first driving gear is connected to the first end portion of the housing and is engaged with the first driving gear.

2. The developer replenishment cartridge according to claim 1, wherein the push rod has a protrusion sleeved with a first spring, and the first spring has one end in contact with the housing.

3. The developer replenishment cartridge according to claim 1, wherein a second spring is provided and has one end bolted to the stop block base and one other end bolted to the stop block.

4. The developer replenishment cartridge according to claim 1, wherein the sealing gear has a gear structure at an end portion thereof, and a discharge port communicating with the outlet is provided at an end portion of the sealing gear.

5. The developer replenishment cartridge according to claim 1, wherein a gear cover is engaged at the first end portion of the housing, and a guiding rail is provided in the gear cover.

6. The developer replenishment cartridge according to claim 1, wherein a positioning pillar is inserted into a groove of the push rod, and the positioning pillar has an end screwed to the housing.

* * * * *